United States Patent [19]

Sykes

[11] Patent Number: 4,905,428

[45] Date of Patent: Mar. 6, 1990

[54] PARTITION STRUCTURES AND FRAME ELEMENTS THEREFOR

[76] Inventor: Christopher C. Sykes, 211 Queens Quay West, Apt. 902, Toronto, Ontario, Canada

[21] Appl. No.: 271,920

[22] Filed: Nov. 16, 1988

[51] Int. Cl.[4] ..... E04B 2/82

[52] U.S. Cl. ..... 52/126.4; 52/239; 52/220; 160/40; 160/135

[58] Field of Search ..... 52/220, 221, 239, 243, 52/481, 578, 582, 126.4, 126.7, 126.5, 126.6; 160/135, 351, 40, 43

[56] References Cited

U.S. PATENT DOCUMENTS

| | | | |
|---|---|---|---|
| 4,056,903 | 11/1977 | Guarnere | 52/126.4 |
| 4,245,442 | 1/1981 | Durham | 52/126.4 |
| 4,391,069 | 7/1983 | Vermillion | 52/126.4 |
| 4,391,073 | 7/1983 | Mollenkampf et al. | 52/221 |
| 4,406,101 | 9/1983 | Heidmann | 52/220 |
| 4,631,881 | 12/1986 | Charman | 160/135 X |

*Primary Examiner*—David A. Scherbel
*Assistant Examiner*—Creighton Smith
*Attorney, Agent, or Firm*—Ridout & Maybee

[57] ABSTRACT

Partition structure has a rigid rectangular frame and rigid rectangular panels received in openings on opposite sides of the frame, with a small clearance between the edges of the panel and the frame. One panel edge is pivotally connected to the frame. The opposite edge of the panel is held securely on the frame by a resilient U-shaped catch received in a slot in a lip on the frame extending rearwardly of the panel. The tongue can be deflected inwardly to free the shoulder from the lip by introducing a thin-bladed tool through the clearance between the panel edge and the frame, so that the panel can then be rocked outwardly about the pivotal connection to an open position. A secure engagement of the panels on the frame is obtained, so that cables or other electrical equipment are securely housed within the partition. By using a small clearance between the panel at the frame, the tongues holding the panels in place are practically indiscernible and the panel securing arrangement is rendered tamper proof. There are also disclosed frame elements and partition structures arranged for stacking of mocular frame elements one on another, for connection of structures at angles to form corner units, for support of electrical cables within the frame elements, for attachment of the upper end of a partition to a ceiling, and for levelling of a frame element on an uneven floor.

23 Claims, 7 Drawing Sheets

11
11a
11b
12
12a
12b
3
4
5
6
7
8
54
56
58
66

PARTITION STRUCTURES AND FRAME ELEMENTS THEREFOR

The invention relates to partition structures and to elements for use in their construction. More especially, although not exclusively, it relates to partition structures for use in offices.

Known partition structures have been formed with demountable facing panels. This allows partitions of a variety of different external appearances or different functions to be produced using the same basic or common frame, and allows a partition installation to be modified, adapted or repaired by substituting new facing panels in place of the existing ones.

Frequently the partitions, especially in offices, need to carry within them electrical cables or other electrical equipment which presents an electrical shock hazard. With known structures, there has been a problem that the partitions are not adequately resistant to tampering, and under some circumstances can accidentally become dislodged. Non-qualified persons may therefore gain deliberate access to the electrical equipment, or workers may accidentally become exposed to an electrical shock hazard as a result of dislodging of a covering panel.

Partition structures are also known which are formed from modular rectangular frame elements, which can be connected together to form partitions of desired width and height. The known arrangements for connecting frame elements disposed one on top of another are not as secure and convenient as may be desired, however. Further with known partition structures, the arrangement for connecting partitions together at an angle to one another to form a corner, or for supporting cables within the partitions, for joining the upper end of a partition to a ceiling, or for levelling a partition if placed on an uneven floor, are not always convenient or do not give the strength in service that may be desired.

The present invention provides frame elements and partition structures whereby the above-noted and other problems of prior devices can be avoided or alleviated.

A partition structure according to the present invention has a rigid rectangular frame and rigid rectangular panels which are received in rectangular openings on opposite sides of the frame, with a small clearance between the edges of the panel and the frame. One edge of each panel has a pivotal connection to the frame. The opposite edge of the panel is held securely on the frame by a catch in the form of a resilient U-shaped tongue attached to the panel and received in a slot in a lip on the frame extending rearwardly of the edge of the panel. The tongue has a shoulder on it engaging the inner side of the lip so that the panel edge cannot be pulled outwardly away from the frame.

The tongue can be deflected inwardly to free the shoulder from the lip by introducing a thin-bladed tool through the clearance between the panel edge and the frame, so that the panel can then be rocked outwardly about the pivotal connection to an open position. With this arrangement a secure engagement of the panels on the frame is obtained, so that the cables or other electrical equipment are securely housed within the partition. By using a small clearance between the panel at the frame, the tongues holding the panels in place are practically indiscernible from the outside, and the panel securing arrangement is rendered tamper proof except to those equipped with knowledge of the operation of the catch and with a thinbladed tool for operating the same.

In other forms or aspects of the present invention there are provided frame elements and partition structures particularly adapted to enable convenient and secure stacking of modular frame elements one on another, connection of structures at angles to form corner units, support of electrical cables within the frame elements, attachment of the upper end of a partition to a ceiling, or levelling of a frame element on an uneven floor. Examples of the above forms of frame elements and partitions in accordance with the invention are described in more detail hereinafter with reference to the accompanying drawings in which:

Figure 1:
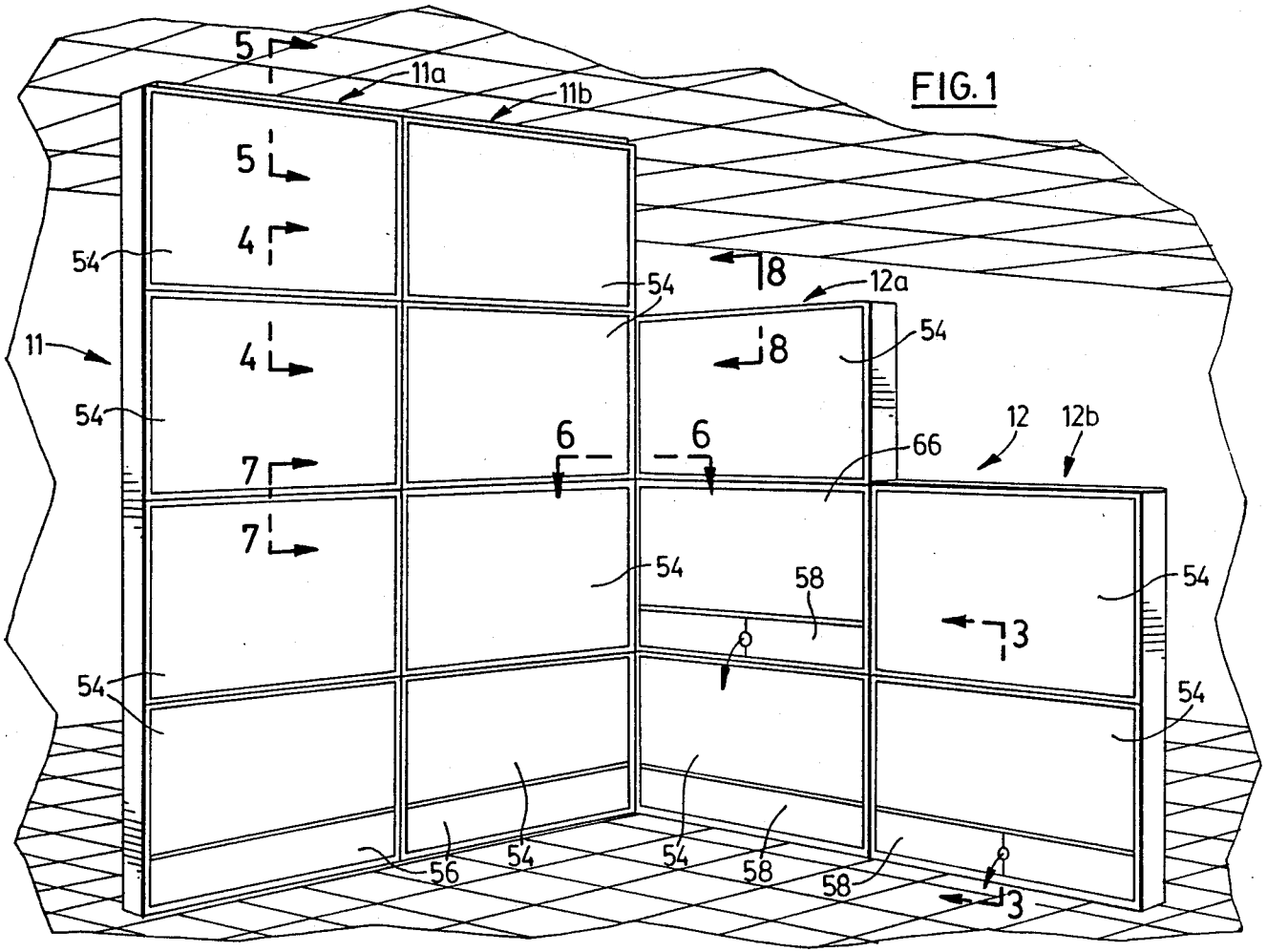
FIG. 1 shows a perspective view of a corner partition structure formed from modular frame elements and facing panels in accordance with the invention.
Figure 4A:
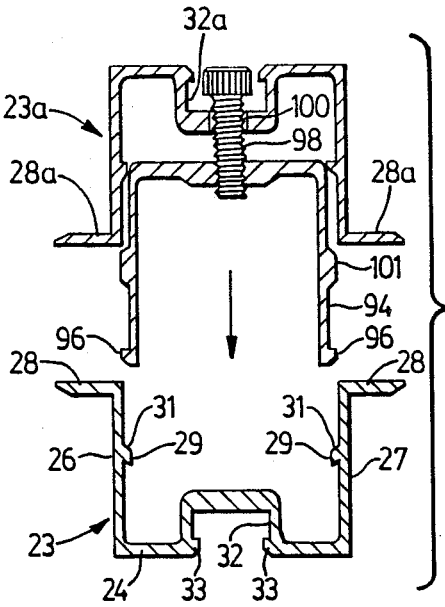
Figure 4B:
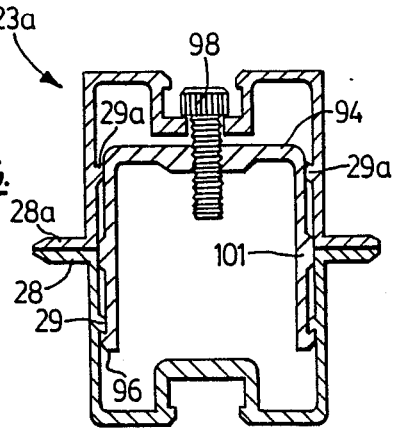
Figure 5A:
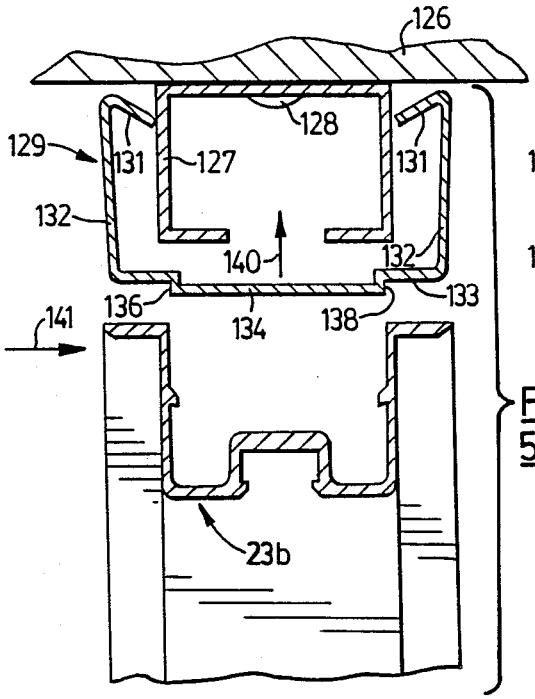
Figure 5B:
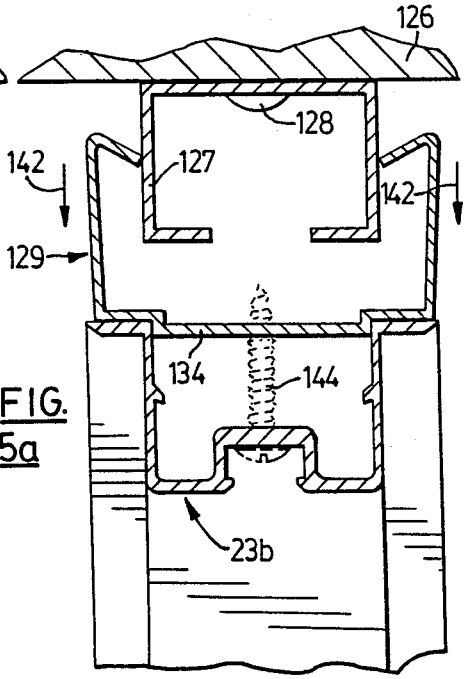
Figure 6B:
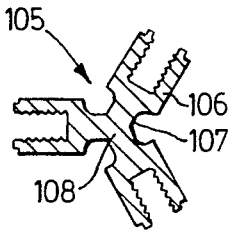
Figure 6A:
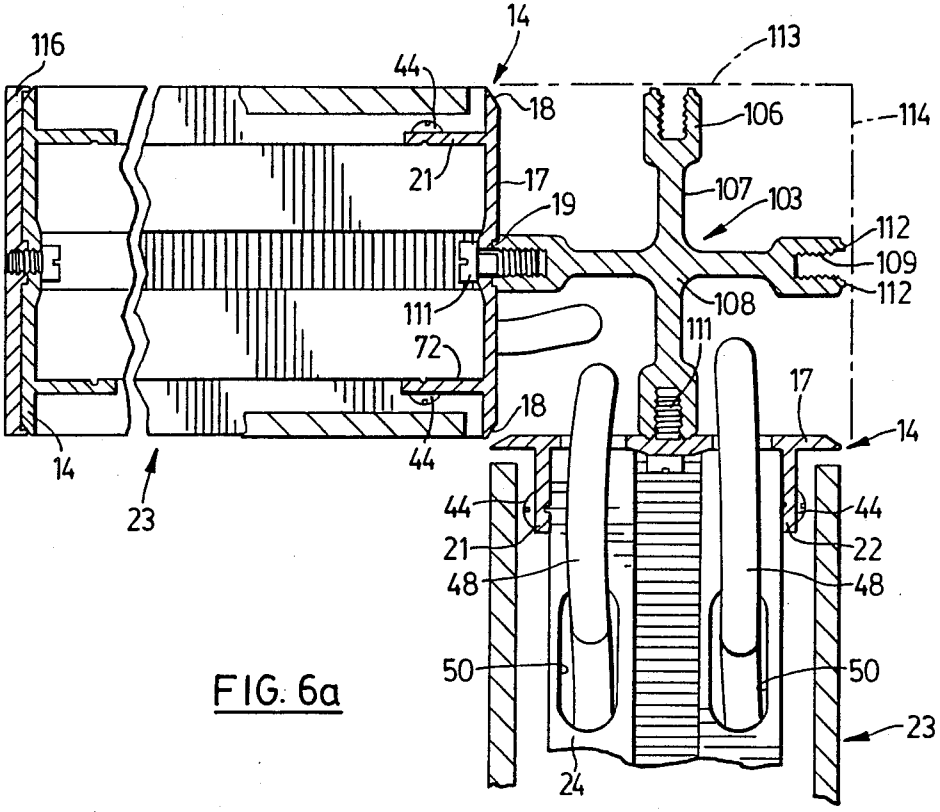
Figure 7B:
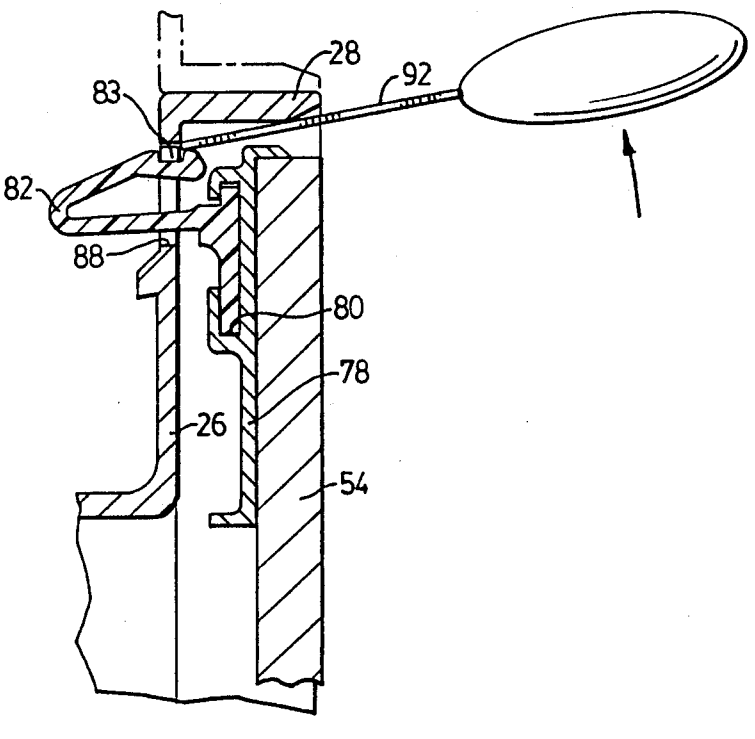
Figure 7A:
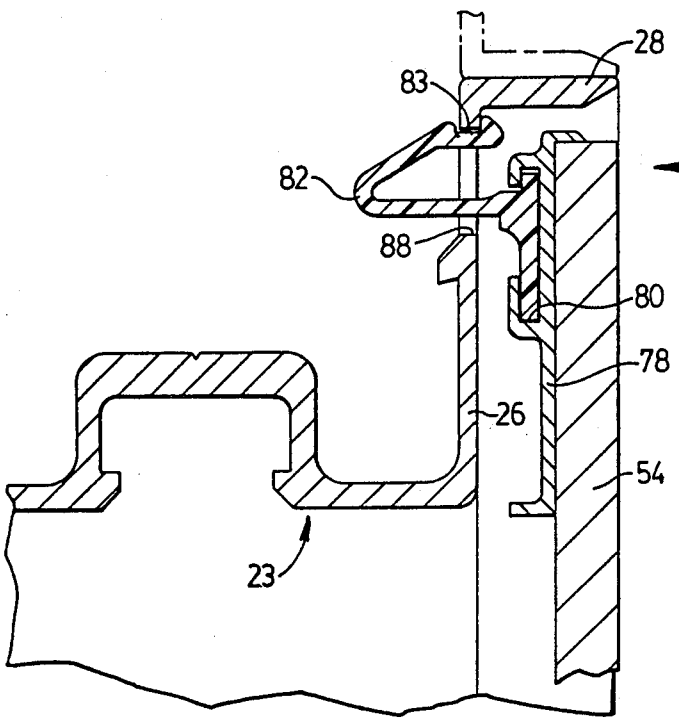

FIGS. 4*a* and 4*b* illustrate the use of an interconnector member for interconnecting modular frame elements one on top of another, and are taken in vertical cross-section on the line 4—4 in FIG. 1;

FIGS. 5*a* and 5*b* illustrate the operation a ceiling connector member used for attaching the upper end of the partition to a ceiling and are taken in section on the line 4—4 in FIG. 1;

FIG. 6*a* is a horizontal cross-section taken on the line 6—6 in FIG. 1, showing a corner connector used for connecting adjacent partitions together at an angle;

FIG. 6*b* shows a cross-section through a further form of connector for use in joining partitions together at an angle of 120°;

FIGS. 7*a* and 7*b* are vertical cross-sections taken on the line 7—7 in FIG. 1 adjacent the edge of a frame member showing the operation of the resilient panel holding catch.

Figure 8A:
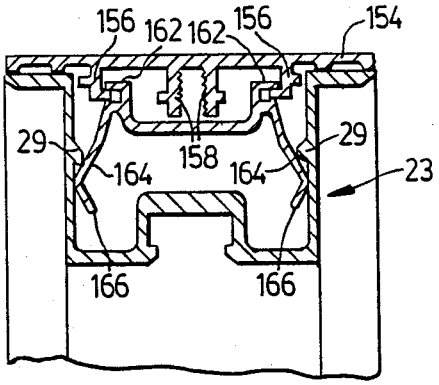
Figure 8B:
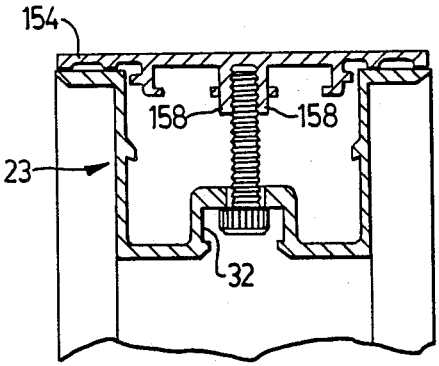

FIG. 8*a* is a vertical cross-section taken on the line 8—8 in FIG. 1 showing a clip-in form of connector used for retaining a horizontal capping plate on the upper side of a partition; and FIG. 8*b* is a vertical cross-section similar to FIG. 8*a* showing a threaded connector used for retaining the capping plate.

Referring to the drawings, FIG. 1 shows an angled or corner unit consisting of two sections 11 and 12 joining at a right angle. Each section consists of two subsections, 11*a* and *b* and 12*a* and *b*.

Figure 2:
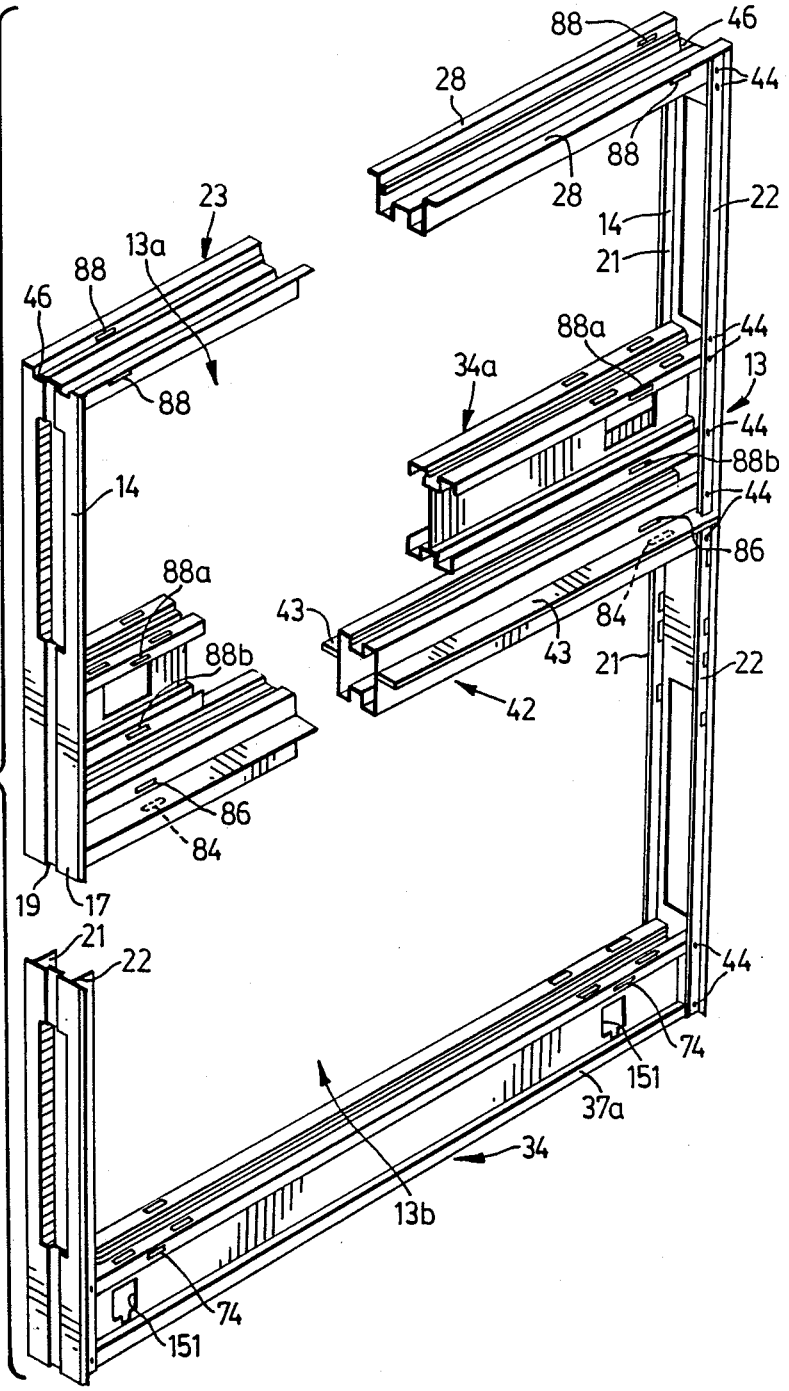
FIG. 2 is a perspective view of one form of rectangular frame element used in the structure of FIG. 1.

The sub-sections are made up of assemblies of rigid rectangular frame elements on which cover panels, face plates and edge plates are connected. FIG. 2 shows a base frame element 3 which constitutes the structural support of the shortest partition sub-section 12*b*. On top of this element 13, modular rigid rectangular frame elements may be connected to form sub-sections of 25 increasing height, such as the sub-sections 11*a*, 11*b* and 12*a*.

The element 13 comprises two continuous side rails 14 part of one of which is shown cut away in FIG. 2, to illustrate the section of the rail. The cross-section is also seen in FIG. 6*a*, and consists of a plate 17 with bevelled edges 18, a narrow central rectangular groove 19, and spaced rearwardly directed flanges 21 and 22. Desirably the rails 14 and all other continuous rails employed in and together with the frame elements are formed by extrusion. Preferably they are aluminum extrusions, but it will be appreciated that other metals or high-strength plastics materials may also be employed.

The element 13 has an upper continuous rail 23, the cross-section of which is best seen in FIGS. 4*a* and 4*b*. It is of generally rectangular channel section with a channel bottom 25 and sides 26 and 27. The width of the channel is such that it fits snugly between the flanges 21 and 22 of the side rails 14. Each channel side 26 and 27 has an outwardly-directed edge flange 28, these flanges 28 being coplanar and forming in effect a peripheral frame, in relation to which the channel sides 26 and 27 form inwardly-directed lips.

Each channel side 26 and 27 has an abutment shoulder 29 on its inner side, each with a downwardly inclining upper face 31.

The channel bottom 24 is formed with a rectangular channel section recess 32 opening into the interior of the frame element 13. Adjacent the mouth of the recess 32, a projection 33 extends inwardly from each side, to form a narrow opening to the recess 32.

Figure 3:
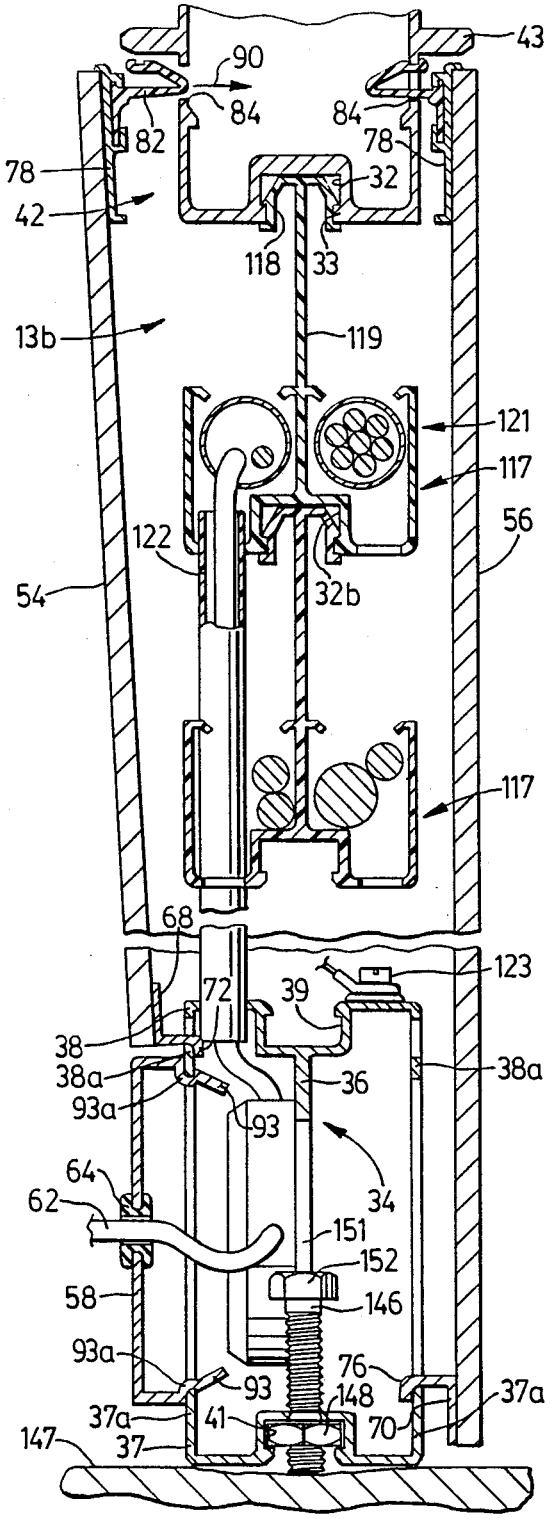
FIG. 3 is a partially fragmentary cross-section through a frame element as in FIG. 2 employed in forming the structure of FIG. 1, and taken on the line 3—3 in FIG. 1.

The continuous bottom rail 34 of the element 13, as best seen in cross-section in FIG. 3, is of generally I-shape, having a vertical web 36, and laterally outwardly and then vertically extending upper and lower end sections 37 and 38. Each end section 37 and 38 is centrally-vertically recessed to provide a narrow-mouthed rectangular channel section recess 39 and 41, similar to the recess 32 in the rail 23. The vertical portions or lips 37*a* and 38*a* of the end sections 37 and 38 are laterally spaced so that they fit snugly between the flanges 21 and 22 of the side rails 14.

The element 13 is provided with a hollow central cross beam 42, which as seen in FIG. 3 is of a unitary cross-section corresponding to that which would be obtained by placing together two of the extrusions 23 in inverted relationship. On each side, therefore, it has flanges 43 which are twice the thickness of the flanges 28.

Further, the element 13 is provided with a service cross beam 34*a*, formed from the same extrusion as the rail 34, for supporting sockets and receptacles for electrical outlets, telephone or other telecommunication services, computers and data processing and the like.

In assembling the frame element 13, the ends of the cross rails or beams 23, 34, 42 and 34*a* are butted to the inner sides of the side rails 14, between the flanges 21 and 22, and the cross beams or rails are secured with fasteners 44 such as self-tapping screws or rivets passed through holes in the flanges 21 and 22 in the side rails at points adjacent vertical sides of the cross beams or rails engaged therein. Preferably, as seen in FIG. 2, the flanges 43 of the hollow cross-beam 42 are notched at each end to receive the flanges 21 and 22. At the upper end of each side rail 14, the flanges 21 and 22 are notched so that the flanges 28 of the channel rail 23 run out to the side of the frame element. The upper end of each plate 17 is notched to provide a recess or recesses, for example as shown at 46 in FIG. 2, so that electrical cables 48 as shown in FIG. 6*a* may be run into the frame element from the exterior, over an upper corner of the frame element, and into the interior of the element through openings 50 stuck through the channel bottom 24.

The side rails 14 are also formed with cut outs, such as, for example, the cut outs 52, through which cables or other service conduits can be introduced into or run through the interior of the element 13.

It will be noted that the width of the side rails 14 is the same as the width of the flanges 28 on the channel rail at the flanges 43 on the hollow cross beam 42, so that on each side of the element, the edges of the flanges 28 and 43 are coplanar with the edges of the rails 14 and form a thin peripheral frame or border around the rectangular openings 13*a* and 13*b* defined between the beam 32 and rail 23 and side rails 14, and between the bottom rail 34, the cross beam 43 and the side rails 14.

In use, cover panels 54 and 56 and cover plates 58 are attached to the frame element 13 to enclose the open sides of the element and provide a partition structure in the form of a rectangular box-like housing. In the preferred form, a standard size of cover panel 54 is employed to cover both the upper opening 13*a* and the lower opening 13*b*. The panel 54 fits closely into the upper opening 13*a*, leaving a small clearance between the edges of the flanges 28 and 43, the side rails 14, and the edges of the panel 54.

Preferably the lower opening 13*b* is wider than opening 13*a* and, as seen in FIG. 3, is closed with one of the standard-sized panels 54 and a cover plate 58 forming a base board, which may be apertured to allow access to sockets or receptacles attached to the. I-beam 34 or through which cables 62 may be led, for example through a resilient grommet 64.

Alternatively, as seen in FIG. 3, a non-standard sized cover panel 56 may be employed to close one side of the opening 13*b*.

As noted above, sub-section 12*b* shown in FIG. 1 is formed by a base frame element 13 together with its cover panels 54 and 56 and plate 58. For ease of reference, the element 13 may be referred to as a "two high unit" since it normally is clad with two of the cover panels 54. To form a higher unit, such as sub-section 12*a*, a rigid rectangular frame element may be stacked on top of a base element 13. Such frame element is preferably dimensioned so that it can be clad with a single standard-sized cover panel 54 and each side, and is therefore conveniently referred to as a "one high unit". The frame element of such one high unit comprises side rails similar to the side rails 14, but of length equal only to the interval between the rail 23 and the cross beam 42 in FIG. 2, and upper and lower channel section rails rigidly joined thereto and formed of the same extrusion as the rail 23, these rails being disposed in inverted relationship to one another so that the larger channel faces outward and the smaller channel recess 32 faces inward.

Still taller units, such as the sub-sections 11*a* and 11*b* can be formed by stacking a further one high unit on a partition structure such as that of sub-section 12*a*. Alternatively, a "three high base unit" may be provided consisting of a rigid frame member comprising side rails similar to the side rails 14 but of length equal to the length of the side rails of the two high unit shown 13 in FIG. 2 plus the length of the sides of the one high unit. The frame has a bottom rail similar to the bottom rail 34, first and second hollow cross beams each similar to the cross beam 42 and spaced at intervals corresponding to the spacings of the cross beam 42 and rail 23 as seen in FIG. 2, and, as the uppermost horizontal member, a rail similar to rail 23. It will be appreciated, therefore, that the rectangular openings formed on each side of such three high unit are adapted to be covered or clad with a base board cover plate 56 and with three standard-sized cover panels 54, as shown in FIG. 1. On top of this three high unit can be stacked a one high unit, as indicated at sub-sections 11*a* and 11*b* in FIG. 1. Where, as indicated in sub-section 12*a* in FIG. 1, it is desired to provide a narrow cover panel 59 at an intermediate height, for example at approximately desk top height to provide access to sockets and receptacles provided in the partition structure at this height, the remaining portion of the opening in the side of the frame may be covered with a non-standard narrower cover panel 66 which is snugly received in the opening leaving only a small clearance between its edges and the adjacent edges of the frame.

Each of these panels 54, 56 and 66 is held onto its frame element by a secure tamper-resistant catch mechanism illustrated in FIGS. 3, 7*a* and 7*b*. Adjacent each side of the lower edge of the panel a small rectangular plate 68 or 70 for example of extruded aluminum or plastic, is attached as by an adhesive or with mechanical fasteners. One style of the plate 68 is formed with a rearward flange with a laterally projecting edge flange extending away from the plate 68 and forming a hooklike projection 72. This projection can be engaged in a slot 74 formed adjacent each end of the bottom rail 34 in its upper vertical portion or lip 38*a*.

An alternative style of the plate 70 has a rearward flange with a hooklike projection 76 facing toward the plate 70. The projection 76 may be hooked over the free edge of the lower vertical portion or lip 37*a* of the bottom rail 34. The lower edge of each panel 54 and 56 is thus prevented from being pulled away from the element 13 by a direct outward pull on the edge of the panel, but is free to pivot or rock about the slot 74 or the lip 37*a*, respectively.

Adjacent each side of the upper edge of the panel 54, 56 or 66 a piece of a generally L-section extrusion 78 is fastened or adhered, the angle of the L-section receiving the corner of the cross section of the panel. The extrusion 78 is formed with a rectangular channel section keyway 80 with reentrant lips, into which is inserted a length of a resilient, preferably plastics material, extrusion having a rectangular base 81 snugly received in the keyway and secured in the keyway with adhesive or fasteners. A generally U-shape tongue 82 extends rearwardly form the base 81 and is formed on its outer side with a rectangular channel 83 forming two opposing shoulders of width to snugly receive the edge of a slot 84 shown in broken lines in FIG. 2 formed in the material of the side wall of the hollow cross beam 42.

In the case in which the panel 54 is to be applied over the upper opening 13*a*, or over similar openings on a one high or three high unit, the lower hooklike projections 72 and 76 may be engaged with slots 86 formed in the side wall of the cross beam 42 or in corresponding positions in the side wall 26 or 27 of the channel section rail forming one side of the one high frame element. The tongues 82 can then be engaged in slots 88 in the side walls 26 or 27 of the channel rail 23 forming the opposite side of the opening, as seen in FIGS. 7*a* and 7*b*.

In each case, the tongue 82 resiliently engages the shoulders of its channel 83 with opposing sides of the material bordering the slot 84 or 88 when the upper end of the panel carrying the tongue is pressed home as indicated by the arrow 90 in FIG. 3. The panel edge is thereby securely held against disengagement from the frame element when an outward pull is applied to the edge. As noted above, the panels 54, 56 and 66 are held on their respective frame elements with only a small clearance between their edges and the adjacent frame sides formed by the flanges 28 or 43. Accordingly, the free ends of the tongues 82 are practically indiscernible unless the edges of the panels are very closely inspected.

In order to free the panel from its mounted position, a thin-bladed tool such as a putty knife 92 may be inserted through the clearance adjacent the panel edge in order to apply inward pressure on the tongue 82, deflecting it resiliently inwardly as shown in FIG. 7*b*, so that the channel 83 is freed from the edge of the slot. The panel edge can then be rocked outwardly about the pivoted connection provided by the hook 72 or 76 allowing access to electrical equipment within the partition or if desired the panel can be lifted to free the hook 72 or 76 from its engagement, thus allowing the panel to be removed. In assembling the partition, or substituting a replacement panel, the above procedure for disassembly is followed in reverse order.

Referring again to FIG. 3, the cover plate 58 preferably comprises a length of resilient plastic extrusion formed with rearwardly and inwardly directed flanges 93 formed with grooves 93*a* which snap fasten between the vertical portions 37*a* and 38*a* of the bottom I section rail 34.

In one alternative form, the upper opening 13*a* of the element 13 shown in FIG. 2 may be clad with an upper cover panel having U-shaped catches similar to the catches 82 received in the slots 88, and hooks such as hooks 72 or 76 received in slots 88*a* in beam 34*a*. A plate similar to plate 58 may be snap fastened between the vertical side portions of the beam 34*a*. A narrow cover panel may be attached with U-shaped tongue catches to slots 88*b* in the lower portion of beam 34*a* and with hooks attaching in slots 86.

The base unit used for the subsection 12*a* may, for example, have an I beam similar to beam 34*a* at approximately the position occupied by hollow beam 42 in FIG. 2. The I beam may receive cover plate 59 which may be a snap-in plate similar to plate 58.

As will be appreciated, various other styles and designs of frame elements may be employed.

Referring to FIGS. 4*a* and 4*b*, these show an arrangement for connecting a frame element having a channel section rail 23*a* along one side, such as a one high unit as described above, on a frame element having an upper channel section rail 23, such as a two high unit as shown in FIG. 2, or a one high or three high unit as described above.

Short lengths of an extruded frame interconnector member 94 are employed. Typically, two or more pieces of the extrusion, e.g. of a few inches in length, are employed at spaced intervals along the length of the channels 23 and 23*a* of the frames to be connected. The interconnector 94 comprises a resiliently compressible channel section which as seen in FIGS. 4*a* and 4*b* is introduced within the rail 23 in inverted position. Each channel side of the interconnector 94 has an outwardly extending engaging rib 96 on its free end, each rib preferably being profiled with an outwardly downwardly inclining surface, so that a camming action is exerted between the ribs 96 and the faces 31 of the shoulders 29 when the member 94 is pushed into the channel of the rail 23, tending to compress the channel sides of the member 94 inwardly and assisting in introduction of the member 94.

The central portion of the channel bottom of member 94 is thickened and is pierced with an aperture which is engaged by a threaded stud 98 passed freely through an opening 100 formed in the bottom of the channel recess 32*a* of the opposed channel 23*a*. The openings 100 are formed through the channel 23*a* at the points where it is desired to employ a member 94, and the members and stud 98 are preferably pre-assembled to channel 23*a* as shown in FIG. 4*a*.

After introduction of the members 94 into the channel 23, the stud 98 is tightened up so that a compressive force is applied between the ribs 96 and shoulders 29, and the rail 23a of the upper element is clamped firmly on top of the rail 23 as shown in FIG. 4*b*, its edge flanges 28*a* seated on the flanges 28.

In the preferred from as shown, the height of the channel of the member 94 is such that it extends into both rails 23 and 23*a* in the clamping position shown in FIG. 4*b*. The width of the channel of the member 94 is such that it is snugly received between the shoulders 29 in the lower rail 23 and the shoulders 29*a* in the upper rail 23*a*. An intermediate portion of each channel side of the member 94 is thickened at 101 to provide a land or outer surface abutting the inner sides of the free ends of the superimposed channels 23 and 23*a* in the clamping position as shown in FIG. 4*b*. Hence, with the preferred form as shown there is no lateral play or freedom of movement between the rails 23 and 23*a* adjacent the interconnector member 94 so that the stability of the connection is increased.

The channel recess 32*a* in the base of the rail 23*a* receives the head of the stud 98 in the clamped position as shown in FIG. 4*b* so that this will not intrude into the space within the frame element above the channel 23*a* and will not interfere with cables or other equipment to be placed within the frame element above the rail 23*a*.

In assembling a partition structure such as shown in FIG. 1, vertically adjacent frame elements are preferably held together using connector members such as shown in FIGS. 4*a* and 4*b*. Horizontally adjacent frame elements are preferably held together with simple mechanical fasteners such as nuts and bolts passed through holes drilled through the side rails 14 of adjacent elements.

Where it is desired to form an angle between two horizontally adjacent elements, as shown in FIGS. 1 and 6*a*, a multiply-lobed connector element 103 or 105 such as shown in FIG. 6*a* or 6*b* is preferably employed.

In each case the connector 103 or 105 is formed as an extrusion, preferably of aluminum, or of other metal, or high-strength plastic, of the cross-section shown, and short pieces are cut off to provide connector elements which are applied at uniformly spaced intervals, e.g. every few feet up the side of the partition structure. Each lobe of each connector has a thickened generally rectangular cross-section end portion 106 joined by a narrower stem 107 to a central portion 108. The outer face of each end portion 106 has a channel section recess 109 in it with serrated edges which receive screws 111 which are passed through holes drilled through the plates 17 of the side rails 14 at the points where the connector elements 103 or 105 are to be employed.

The outer face of each end portion 106 is provided with a pair of rectangular stub flanges 112 dimensioned so that they fit snugly in the central rectangular groove 19 on the outer side of the rails 14, so that the connector members 103 or 105 are securely located against lateral movement relative to the rails 14.

If the outer sides of the corner shown in FIG. 6*a*, employing the cruciform connector 105, are exposed, they can be given a neat appearance by applying corner cover plates in the positions shown in broken lines at 113 and 114. Such plates, preferably extruded from aluminum, have adjacent their centre a pair of rearwardly-directed flanges each with a reentrant lip at its free end. The flanges are sufficiently thin that they can be flexed resiliently outwardly to enable them to be snapped onto the thickened end portion 106 of the connector.

FIG. 6*b* shows a connector with its lobes arranged at 120°, so that, for example, a hexagonal island of the partitions can be formed.

A similar connector of generally T-section can also be employed.

As seen in FIG. 6*a*, the outer ends of the partition structures may be capped with a vertical capping plate 116, preferably an aluminum extrusion of the cross-section shown, which is screwed to the outer side of the side rail 14 with screws passed through openings drilled at intervals through the central portion of the rail 14.

Referring again to FIG. 3, this shows snap-in resilient plastics cable carriers 117 used for supporting cables 118 run through the interior of the base element 13.

The carriers 117 are preferably extruded and usually are employed in the form of pieces of a few inches in length cut from the extrusion. The upper portions of the carriers 117 are adapted to snap couple into the channel sections recess 32 formed in the lower side of the hollow cross beam 42. The carriers are laterally symmetrical and their upper portions comprise laterally outwardly and downwardly extending wings 118 each formed on its outer side with a rectangular section groove which engages the rectangular projections 33 bordering the mouth of the recess 32 including their upper sides. In the snapped-in position shown in FIG. 3 the wings 118 are laterally compressed between the projections 33 so that they are held tightly in place and resist withdrawal although they can be slid longitudinally along the recess 32. The lower ends of wings 118 emerge from the recess 32 so that they can be engaged e.g. with the blade of a screw driver to compress them internally so that they can be freed from the recess if desired.

Each carrier includes a central wall or septum 119 connecting to a lower portion 121 having an upwardly extending cable supporting channel on each side. The lower face of the carrier is formed with a recess 32*b* similar in cross-section to the recess 32 so that a similar cable carrier can be snapped coupled into it, as seen in FIG. 3.

Plastic conduits 122 may be passed through openings in the cable supporting channels of the cable carriers 117 in order to convey cable between upper and lower regions of the partition.

One further advantage of using frame elements formed from aluminum or other metal is that they can serve to ground electrical components using for example a grounding screw 123 engaging a rail such as the rail 34.

FIGS. 5*a* and 5*b* show an arrangement for connecting the partition structure to a ceiling 126. At the point where it is desired to position the partition, a rectangular section bar, for example a wooden plate or stud or a hollow rectangular section metal rail 127 as shown is secured to the ceiling with fasteners 128. A resilient channel section ceiling connector member 129 is used to connect the rail 127 to an upwardly open channel 23*b* forming a top rail of a partition structure, which may be for example a one high unit as described above.

The connector member has a flange 131 extending inwardly and preferably downwardly from each of its channel sides 132, and its channel bottom 133 is formed with a rectangular section depression 134 providing parallel opposing side surfaces 136 and 138 spaced apart the width of the channel in the rail 23. In use the connector member 129 is applied over the rail 127 with the flanges 131 resiliently gripping the sides of the rail and is pushed to an upper assembly position as shown by the arrow 140 in FIG. 5*a*. The partition including the rail 23*b* is then erected, usually flat on the floor, and then rocked upwardly to a position underneath the connector 129 and the rail 127 as shown by the arrow 141. The connector 129 is then pulled downwardly relative to the rail 127 as shown by the arrows 142 in FIG. 5*b* until the rectangular depression 134 engages the upper end of the channel rail 23*b* with the side surfaces 136 and 138 snugly engaging the opposing channel sides and retaining the partition structure against lateral movement. If desired, a screw 144 may be passed through an opening drilled through the channel bottom of the rail 23*b* and into the base of the connector member 129 in order to provide a connection with greater resistance to any lateral movement.

Referring again to FIG. 3, this shows a leveller bolt 146 which in the example shown is used to raise the bottom rail 34 of the base element 13 slightly above the surface of the floor 147 in order to level a partition structure where the floor surface is uneven. The bolt 146 may be threaded into a threaded opening in the rail 34 itself where the rail is of sufficient hardness but where, as in the preferred form the rail 34 is an aluminum extrusion, the bolt is preferably threaded through a hexagonal nut 148. The nut 148 is of such size that it fits snugly within the lower channel recess 41 in the rail 34. Opposing flat sides of the nut 148 engage the opposing channel sides of the recess 41 so that the nut is nonrotatable. Each bolt 146 is accommodated in a rectangular cut out 151 also seen in FIG. 2 so that it is accessible by a wrench or like tool, and is passed through a hole drilled through the bottom of the recess 41. The bolt 146 is arranged with its tool-engaging head 152 uppermost and its threaded shank extending downwardly so that where, as is frequently the case, the floor surface 147 is perfectly even, the bolts 146 can be kept in retracted condition within the bottom rail 34, so that normally they are not visible.

FIGS. 8*a* and 8*b* show alternative arrangements for retaining a horizontal capping plate 154 on the top of an upper channel section rail 23 of a partition structure such as the two high base unit of FIG. 3. The plate 154 is preferably an aluminum extrusion and on its lower surface carries a pair of spaced inwardly directed generally L-shaped flanges 156, and a central pair of spaced flanges 158, the inner sides of which are serrated.

In FIG. 8*a* a resilient, preferably extruded aluminum, connector member 160 is employed, usually in the form of short pieces spaced at regular intervals along the length of the plate 154. The connector is formed with outwardly directed spaced L-shaped flanges 162 and normally the connector is engaged with the plate 156 at one end and slid along the plate to the desired positions with the flanges 162 engaging the flanges 156 as shown. The corrector has resilient outwardly and downwardly extending flanges 164 terminating in inwardly extending portions 166 which through camming action on the upper side of the shoulder 29 are compressed inwardly allowing the plate 154 with the connector members 160 to be snap assembled to the position shown in FIG. 8*a*.

In FIG. 8*b*, threaded studs 168 are passed at intervals through holes drilled at intervals in bottom of the channel recess 32 and engage the serrated sides of the flanges 158 to retain the cap 154.

I claim:

1. A partition structure comprising a rigid rectangular frame element formed by peripheral rails defining a rectangular opening therein; at least two opposing ones of said rails each having a lip on each side of the rail directed inwardly toward the opening; a pair of rigid rectangular panels dimensioned to fit snugly into the openings on the outer sides of the lips on respective opposite sides of the frame element leaving a small clearance between the rails and the panel edges; each panel having means for pivotally connecting one edge thereof to one lip and preventing disengagement from the lip by outwardly pulling on the panel edge; the opposite lip having in it a slot parallel to the panel edge; and the panel having a resilient U-section tongue connected on its rear face and normally received in the slot, with a shoulder on the tongue engaging the inner side of the lip and preventing disengagement from the lip by outwardly pulling on the panel edge, the tongue being exposed through said small clearance whereby it may be engaged by a thin-bladed tool inserted through said clearance and may be deflected inwardly to free the shoulder from the lip and allow the edge of the panel to be rocked outwardly from the frame element about said pivotal connection.

2. A partition structure as claimed in claim 1 wherein the tongue has a second shoulder opposing the first-mentioned shoulder, said second shoulder engaging the outer side of the lip, and a recess between the shoulders receiving the edge of the lip.

3. A partition structure as claimed in claim 2 wherein said shoulders and recess define a rectangular section channel snugly receiving the edge of the lip.

4. A partition structure as claimed in claim 1 wherein at least one of said rails has an opening therein for introducing a current carrying electrical cable into the interior of the structure.

5. A partition structure as claimed in claim 1 wherein said means for pivotally connecting comprise a hook-shaped projection on the rear side of the panel, and a slot in the said one lip receiving said hook-shaped projection.

6. A partition structure as claimed in claim 1 wherein said opposite lip is provided with at least one further slot parallel to the panel edge and spaced from said first-mentioned slot, and said panel has at least a further resilient U-section tongue connected on its rear face for each said further slot, each such further tongue received in its respective slot and having a shoulder engaging the inner side of the lip to prevent disengagement of the panel edge on an outward pull thereon except when the tongue is resiliently deflected inwardly by application of a thin-bladed tool introduced through said clearance.

7. A connectible frame element for a partition structure comprising a rigid rectangular frame formed by two opposing side rails and upper and lower horizontal rails at least one of which is of rectangular channel section with the opening of the channel facing outwards, and an abutment shoulder extending inwardly into the channel on each channel side; and a frame interconnector comprising a resiliently compressible channel section member dimensioned to be introduced in inverted position within said horizontal channel section rail and having an outwardly extending engaging rib on the free end of each channel side, said rib in a normal position engaging respective abutment shoulders of the channel of the rail to prevent withdrawal from the rail and the interconnector member being laterally compressible to allow said rib to move past the shoulders and allow introduction of the interconnector; and releasable connector means for connecting the interconnector member to the channel rail of a second frame element similar to the first-mentioned frame element when superimposed therein; and wherein said frame elements each have an edge flange extending laterally outwardly from the free end of the channel side of each channel rail, the edge flanges of said second frame element seating on the edge flanges of the first-mentioned frame element.

8. A frame element as claimed in claim 7 wherein the interconnector member is dimensioned so that its channel bottom extends into the channel of the horizontal rail of said second frame element when in said normal position.

9. A frame element as claimed in claim 8 wherein an intermediate portion of each channel side of the interconnector member is thickened to provide a land abutting the inner sides of the free ends of superimposed channel rails of the first mentioned and second frame elements when in said normal position.

10. A frame element as claimed in claim 7 wherein each horizontal channel rail has an inwardly entrant channel section depression in its channel bottom opening to the outer side of the channel bottom, and the releasable connector means comprise a tensile member having a shank threaded into a threaded aperture in the channel bottom of the interconnector member and passing through an opening in the inwardly entrant channel of said second frame element, and an enlarged head engaging the channel bottom of the inwardly entrant channel.

11. A corner partition structure comprising first and second rigid rectangular frame elements each having at least one side rail formed with an opening receiving a threaded connector member; and a corner connector comprising a short length of an extrusion which is multiply lobed in cross section, each lobe having a channel section recess with serrated inner sides, the threaded connector of each frame element threadedly engaging a respective serrated recess.

12. A partition structure as claimed in claim 11 wherein each lobe comprises in cross-section a narrow intermediate portion and a wider end portion having said recess therein.

13. A partition structure as claimed in claim 11 wherein each lobe has a rectangular stub flange on each side of the recess, and each frame element has a rectangular groove along each side snugly locating said flanges therein.

14. A partition structure as claimed in claim 11 wherein the corner connector has said lobes disposed to form a uniformly cruciform cross section.

15. A partition structure as claimed in claim 11 wherein said corner connector has three lobes disposed 120° apart in cross section.

16. A cable housing frame element for a partition structure comprising a rigid rectangular frame formed by two opposing side rails and upper and lower horizontal rails at least one of which is formed with a channel section recess opening toward the interior of the frame element and having a projection extending inwardly from each side thereof; and an extruded resilient plastics material cable carrier having in cross section an upper end with laterally outwardly and downwardly extending wings each formed with a shoulder which in a normal position snap couples in the recess and engages the upper side of a respective one of said projections to resist withdrawal, and each wing extending outwardly from the recess to allow the wings to be grasped and laterally compressed to allow withdrawal from the recess, and a lower portion having an upwardly open channel for receiving electrical cables.

17. A frame element as claim in claim 16 wherein the lower portion of the cable carrier has in its lower surface a channel section recess similar to the recess in said one rail, whereby the upper end of a similar cable carrier can be snap coupled therein.

18. A frame element as claimed in claim 16 wherein each projection is of rectangular section and each wing has a rectangular section groove therein, one edge of which defines said shoulder, said groove snugly receiving said projection.

19. A ceiling connectible frame element for a partition structure comprising in combination a rigid rectangular frame formed by two opposing side rails and upper and lower horizontal rails at least one of which is formed with a channel section recess opening to the outer side of the frame, and a resilient channel section ceiling connector member having a flange extending inwardly from each channel side whereby the flanges can resiliently grip the outer sides of a rectangular section ceiling bar intended to be secured to the ceiling at the point where the frame element is to be connected to the ceiling, and parallel lower side surfaces which snugly engage the inner sides of the channel of said horizontal rail, so that the connector can be slipped downwardly relative to the ceiling bar from an upper assembly position allowing the channel of said one rail of the frame element to be positioned under the connector member to a lower anchoring position wherein said side surfaces engage on the sides of the channel of said horizontal rail.

20. A frame element as claimed in claim 19 wherein each flange extends inwardly downwardly into the channel of the connector member.

21. A frame element as claimed in claim 19 wherein the lower side surfaces of the connector member are formed by the side surfaces of a rectangular section depression formed in the channel bottom of the connector member.

22. A base frame element for a partition structure comprising a rigid rectangular frame formed from opposing side rails and upper and lower horizontal rails, the lower rail provided at longitudinally spaced points with leveller means comprising a threaded opening adjacent the lower side of the rail, a threaded shank engaging said opening and having a free end adjacent the lower side of the rail and a tool engaging head having planar vertically extending tool engaging surfaces disposed above the opening wherein said lower rail has a channel section recess facing toward the outer side of the frame element and having a projection extending inwardly from each side, and said threaded opening is provided by a flat sided threaded member non-rotatably located in the recess with its flat sides engaging the sides of the channel.

23. A frame element as claimed in claim 22 wherein the flat sided member is a hexagonal nut.

* * * * *